US007646005B2

(12) United States Patent
Chase et al.

(10) Patent No.: US 7,646,005 B2
(45) Date of Patent: Jan. 12, 2010

(54) VARIABLE LENGTH ADJUSTABLE FLAME SCANNER

(75) Inventors: Paul H. Chase, Suffield, CT (US); William M. Clark, III, Windsor, CT (US); Pio Joseph Fusco, Wethersfield, CT (US)

(73) Assignee: ALSTOM Technology Ltd (CH)

( * ) Notice: Subject to any disclaimer, the term of this patent is extended or adjusted under 35 U.S.C. 154(b) by 188 days.

(21) Appl. No.: 12/020,878

(22) Filed: Jan. 28, 2008

(65) Prior Publication Data

US 2009/0190186 A1 Jul. 30, 2009

(51) Int. Cl.
*G02B 7/02* (2006.01)
*F23N 5/08* (2006.01)

(52) U.S. Cl. ..... 250/554; 250/227.26; 340/578; 341/79

(58) Field of Classification Search ..... 250/554, 250/227.11, 227.26; 340/578; 341/79
See application file for complete search history.

(56) References Cited

U.S. PATENT DOCUMENTS 3,241,595 A * 3/1966 Gilbert ..... 431/23
4,309,165 A * 1/1982 McElroy ..... 431/8
7,289,032 B2 10/2007 Seguin et al.
7,382,140 B2 * 6/2008 Obrecht ..... 324/678
2004/0013374 A1 * 1/2004 DiGiovanni et al. ..... 385/96
2005/0266363 A1 * 12/2005 Ganeshan ..... 431/79
2009/0190186 A1 * 7/2009 Chase et al. ..... 358/474
2009/0207510 A1 * 8/2009 Chase et al. ..... 359/820

FOREIGN PATENT DOCUMENTS

WO 2006091617 A1 8/2006

* cited by examiner

*Primary Examiner*—John R Lee
(74) *Attorney, Agent, or Firm*—Cantor Colburn LLP

(57) ABSTRACT

An apparatus for varying a length of a flame scanner assembly for monitoring a flame includes a mounting shaft which connects to a fiber optic cable assembly; and a spool assembly having a first end and a second opposite end. The first end connects to a detector head assembly and the second end is configured to connect to a guide pipe. The second end of the spool assembly receives one end of the mounting shaft and a length of the flame scanner assembly is adjusted via telescopic interconnection between the second end of the spool assembly and the one end of the mounting shaft such that longitudinal displacement therebetween may be varied by slidable displacement of the mounting shaft relative to the spool assembly.

20 Claims, 4 Drawing Sheets

VARIABLE LENGTH ADJUSTABLE FLAME SCANNER

TECHNICAL FIELD

The present invention is related to a flame scanner for monitoring flames produced by a fossil fuel fired combustion chamber, and more particularly to such a flame scanner for new and retrofit applications that ensures that the flame scanner is properly seated with a guide pipe to indicate both the presence and characteristics of a flame.

BACKGROUND

A flame scanner monitors the combustion process in a fossil fuel fired combustion chamber to provide a signal indicating the presence or absence of a stable flame. With the presence of a stable flame, fossil fuel continues to be fed into the combustion chamber of the steam generator. In the event that the flame becomes unstable, or the flame is lost completely (known as a flame out condition), the flame scanner provides a loss of flame signal. Based upon a loss of flame signal, fossil fuel delivery to the combustion chamber can be discontinued before an undesirable unstable operating condition or flame out condition develops. In some systems, a human operator interrupts the fuel supply based upon the loss of flame signal; in other systems a burner management system (BMS) interrupts the fuel supply based upon the loss of flame signal.

Conventional flame scanners produce an electrical signal based upon a monitored flame. This resulting analog electrical signal is transmitted to processing electronics that are housed separately from the flame scanner, typically in an equipment rack located adjacent to a control room. The strength of the produced signal is typically proportional to the intensity of the monitored flame. If the signal strength falls below a lower set point, or rises above an upper set point, delivery of main fuel into the combustion chamber is interrupted. Set points are sometimes referred to as trip points.

One type of flame scanner is an ultraviolet tube flame scanner which produces a pulsed electrical output whose pulse rate is proportional to the intensity of ultraviolet light, in the range of approximately 250 to 400 nanometers, emitted by a flame. These scanners are particularly suited for monitoring gas flames since the emission from gas flames can be primarily in the ultraviolet range, with only minimal visible light emissions. Ultraviolet flame scanners based on Geiger mueller tubes require extensive maintenance and have relatively limited operational lives as well as unstable failure modes.

Another type of flame scanner is a photodiode flame scanner. Photodiode flame scanners are the most prevalent type of flame scanner in use today in industrial application. In these flame scanners, visible light, in the range of approximately 400 to 700 nanometers, is collected from inside a combustion chamber, transmitted through a fiber optic cable, and directed onto a single photodiode to produce an electrical signal utilized by the separate processing electronics. Photodiode flame scanners are well suited for monitoring oil and coal flames, as emissions from such flames are in the visible and near infrared ranges.

Photodiode flame scanners mount on utility or industrial boilers and include two primary components. One component is a removable flame scanner assembly, i.e., a flame sensor and fiber optic cable. The flame sensor senses energy from the boiler via light transmission from the boiler flames by way of the fiber optic cable. The other component of the flame scanner includes a scanner guide pipe, which is a fixed, structural part of the boiler and disposed within the combustion chamber of the boiler. The flame scanner assembly fits into the guide pipe. In order for maximum efficiency of light transmission from the flame front inside the boiler to the flame sensing electronics located outside of the boiler, the tip of the flame scanner assembly must be seated firmly at a corresponding fireside end of the guide pipe. Therefore a length of the removable flame scanner assembly must match a length of the scanner guide pipe within fractions of an inch. Preferably, the flame scanner assembly is manufactured to be ⅜" to ½" longer than the guide pipe to insure compression of the flame scanner assembly to seat the tip of the flame scanner assembly firmly at the fireside end of the guide pipe.

There has been a long history of flame scanner assembly/guide pipe dimensional size issues, i.e., variation in length when installing and mating the two primary components. For example, referring to FIGS. 2 and 3 only for reference to dimensions of the longitudinal length of the flame scanner assembly and guide pipe, respectively, some of the design and fit-up issues of a flame scanner include matching an "A" dimension of the guide pipe with an "L" dimension of the flame scanner assembly, where "A" is the internal length of the guide pipe for receiving the flame scanner assembly and "L" is the length of the flame scanner assembly that is disposed within the guide pipe. For example, on new orders and existing orders, mismatches between the "A" and "L" dimensions occur due to drawing revisions not being up to date or field changes to equipment not being recorded. Achieving a ½" compression at "0" tilt on the scanner in the field has been a tremendous problem, as guide pipes tend to be installed and fit-up differently at each site. With some flame scanner assemblies, costs are incurred with the selection of variable lengths of the fiber optic cables and lengths of adaptation pipe extensions.

In addition, flame scanners often experience what is known as "pull back" during operation of the boiler (tilting) caused by guide pipes that have stretched over time. Further, guide pipes tend to sag over time. When a scanner has "pull back" issues during tilting or with old equipment, the flame scanner performance degrades substantially. Moreover, purge air is no longer directed across a lens barrel of the flame scanner assembly to remove contaminants from the lens or the quartz window when the scanner guide pipe sags or experiences "pull back", thus reducing flame scanner performance.

Accordingly, a need exists for an adjustable/variable length flame scanner that will permit quick and easy adjustment of miss matched lengths of the guide pipe and flame scanner assembly.

SUMMARY

According to the aspects illustrated herein, there is provided an apparatus for varying a length of a flame scanner assembly for monitoring a flame. The apparatus includes a mounting shaft which connects to a fiber optic cable assembly; and a spool assembly having a first end and a second opposite end. The first end connects to a detector head assembly and the second end is configured to connect to a guide pipe. The second end of the spool assembly receives one end of the mounting shaft and a length of the flame scanner assembly is adjusted via telescopic interconnection between the second end of the spool assembly and the one end of the mounting shaft such that longitudinal displacement therebetween may be varied by slidable displacement of the mounting shaft relative to the spool assembly.

According to the other aspects illustrated herein, there is provided a flame scanner for monitoring a flame in a boiler. The flame scanner includes: a head assembly containing electronic components; a lens assembly including a lens; a fiber optic cable extending between the lens and the electronic components; a spool assembly having a chamber disposed therein, the chamber receiving a portion of the fiber optic cable; a sleeve disposed around the fiber optic cable and extending between the lens assembly and the spool assembly; and a mounting shaft disposed between the sleeve and the spool assembly. A length of the flame scanner is adjusted via telescopic interconnection between the spool assembly and the mounting shaft such that longitudinal displacement therebetween may be varied by slidable displacement of the mounting shaft relative to the spool assembly.

According to the still other aspects illustrated herein, there is provided a method to vary a length of a flame scanner assembly to match a length of a guide pipe in which the flame scanner is installed for monitoring a flame. The method includes: disposing one end of a mounting shaft in a barrel defining one end of a spool assembly; slidably displacing the mounting shaft relative to the spool assembly to adjust a length of the flame scanner in a telescopic manner; and extending a mechanical fastener through the one end of the spool assembly to the mounting shaft to prevent further slidable displacement of the mounting shaft relative to the spool assembly and fix a longitudinal displacement therebetween.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 1:
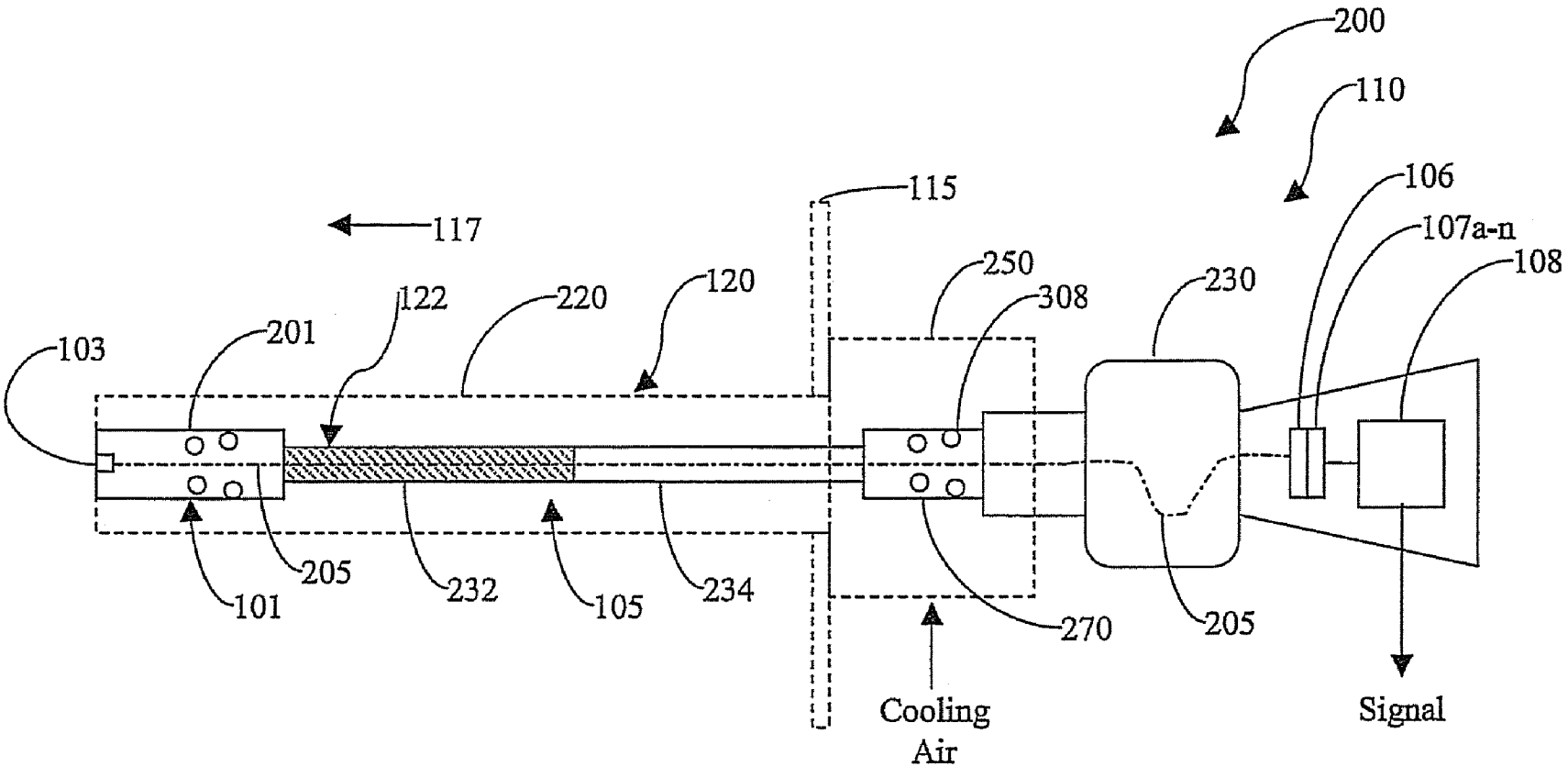
FIG. 1 is a simplified schematic depiction of a flame scanner assembly in accordance with an embodiment of the present invention.

With reference to the Figures, and particularly to FIG. 1, included in a flame scanner assembly 100 of the present invention are a flame scanner 200 and a guide pipe assembly 120, which secures the flame scanner 200 to wall 115 of a combustion chamber. The flame scanner 200 includes a lens assembly 101, a fiber optic cable assembly 105, a spool assembly 230, and a detector head assembly 110. The guide pipe assembly 120 includes a guide pipe 220, which extends within the combustion chamber 117, and a manifold coupling 250, which is disposed outside the combustion chamber 117 and is attached to wall 115. The detector head assembly 110 and the spool assembly 230 are mounted to the outside wall 115 by the manifold coupling 250, while the lens assembly 101 is positioned inside the guide pipe 220 within the combustion chamber 117. The fiber optic cable assembly 105 extends within the guide pipe 220 and manifold coupling 250 to connect the spool assembly 230 and detector head assembly 110 to the lens assembly 101 through the outside wall 115. Preferably, all metal components of the lens assembly 101 and the fiber optic cable assembly 105 that are subjected to high heat are constructed of type 304 stainless steel. Flame scanner 100 may be, as desired, utilized in either tangential fired (T-fired) or wall-fired boilers, as well as used with any, or all of, coal-, oil-, gas-, and/or other fuel-fired burners.

The lens assembly 101 includes a replaceable quartz lens 103. The fiber optic cable assembly 105 includes a fiber optic cable 205 that extends from the lens 103, through the lens assembly 101 and through a protective sleeve 122 that connects the lens assembly 101 to the spool assembly 230 and detector head assembly 110. The protective sleeve 122 is made of a material suitable to protect the fiber optic cable 205 from the environmental conditions within the combustion chamber 117. In the embodiment shown, protective sleeve 122 is made of a steel flex hose 232 and a steel pipe 234 connected to the flex hose 232. It will be appreciated, however, that the protective sleeve 122 may be made of any material that protects the fiber optic cable 205 from environmental conditions within the combustion chamber 117. The fiber optic cable 205 transmits light collected by the quartz lens to a splitter 106 located inside the detector head assembly 110. Quartz or other cables may be utilized, as desired.

In this embodiment, the splitter 106 directs the collected light onto each of multiple photodiodes 107*a*-107*n*. Preferably, six photodiodes are utilized, however, fewer or more photodiodes could be utilized, as desired. Each photodiode 107*a*-107*n* converts light energy into an electrical signal. Each electrical signal is then sent to an onboard digital signal processor 108. Use of an onboard digital signal processor 108 replaces the separate and remote processing electronics of conventional flame scanners. However, conventional flame scanners with remote signal processing would be an acceptable option. In any case, the flame scanner 200 may output a signal indicative of a condition of the flame in combustion chamber 117.

The manifold coupling 250 receives air from an external source, and internal channels within the manifold coupling 250 direct the air to apertures 308 disposed within a mounting shaft 270, which is attached to the end of the sleeve 122. This air passes through the apertures 308 and through the sleeve 232 to the lens assembly 101 to cool the fiber optic cable 205 and clean the lens 103 from debris. Air from the manifold coupling 250 may also pass between the guide pipe 220 and fiber optic cable assembly 105 for cooling and cleaning purposes.

The spool assembly 230 has a chamber disposed therein for receiving one or more coils, or other excess amount, of fiber optic cable 205. The mounting shaft 270 is slidably received within one end of the spool assembly 230 and may be pushed axially into, or pulled axially outward from, the spool assembly 230, thereby adjusting the length of the flame scanner 200. The spool assembly 230 receives excess fiber optic cable 205 when the flame scanner 200 is shortened, and the excess fiber optic cable 205 in the spool assembly 230 provides sufficient cable 205 for lengthening of the flame scanner 200. Once the desired length is achieved, the mounting shaft 270 may be locked in place relative to the spool assembly 230 to fix the flame scanner 200 length. This "telescopic" adjustment in flame scanner 200 length allows for variations in flame scanner length due to loose manufacturing tolerances or poor documentation, while still achieving a proper fit up in the field.

Figure 2:
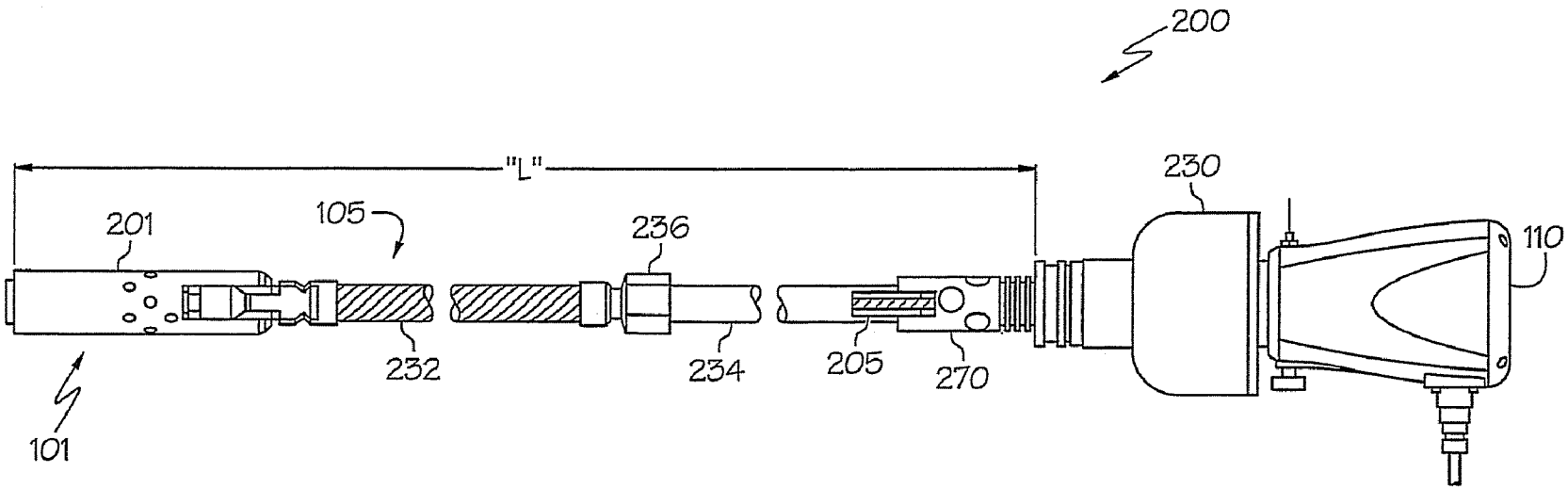
FIG. 2 is a side elevation view and more detailed view of the flame scanner of FIG. 1 removed from a guide pipe and boiler and having a lens assembly connected to head and spool assemblies via a fiber optic cable assembly.

FIG. 2 is a side elevation view and more detailed view of a flame scanner 200 of FIG. 1 removed from the boiler and having the lens assembly 101 connected to detector head and spool assemblies 110 and 230, respectively, via the fiber optic cable assembly 105 in accordance with an embodiment of the present invention. The lens assembly 101 includes a stainless steel scanner optical head 201 which houses a lens (not shown) that couples the light energy from the burner flame into a high temperature fiber optic cable 205 of the fiber optic cable assembly 105.

On tilting tangential boilers, the fiber optic cable 205 allows the scanner 200 to tilt with the corner so that the scanner always has a clear view of the fireball or oil gun. On wall fired units, the fiber optic cable 205 allows the scanner lens to have an unobstructed view of the flame allowing for unsurpassed flame discrimination under all operating conditions.

In an exemplary embodiment, for example, but is not limited thereto, the fiber optic cable 205 is a fiber optic bundle encapsulated in a stainless steel overbraid flex cable (not shown). The fiber optic cable 205 is disposed within the protective sleeve 122, which may comprise a ½ inch outer stainless steel flex hose 232 and a ½ inch schedule 40 pipe 234 connected to the flex hose 232 using a coupling nut 236. The pipe 234 is connected to the spool assembly 230.

Figure 3:
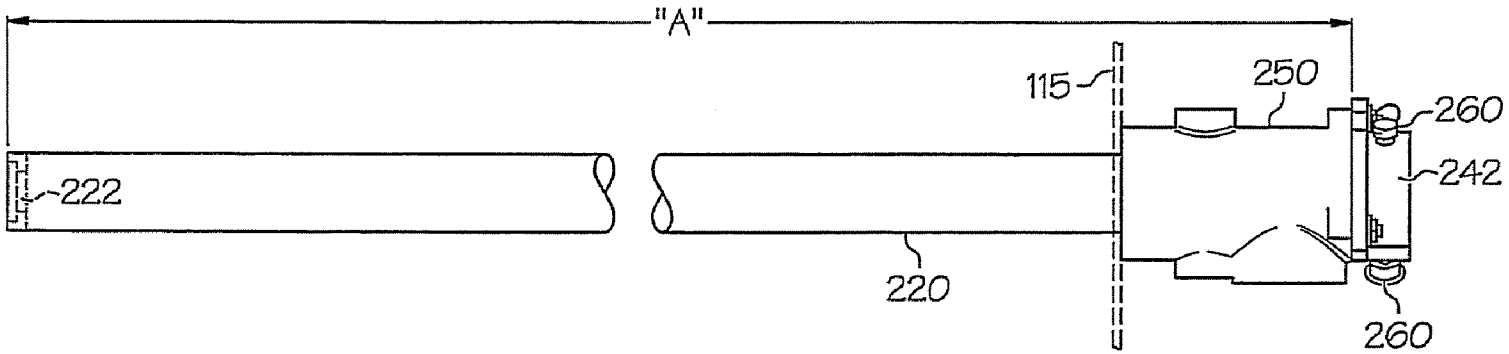
FIG. 3 is a side elevation view of one embodiment of a guide pipe and cooling air manifold coupling to receive the flame scanner of FIG. 2.
Figure 4:
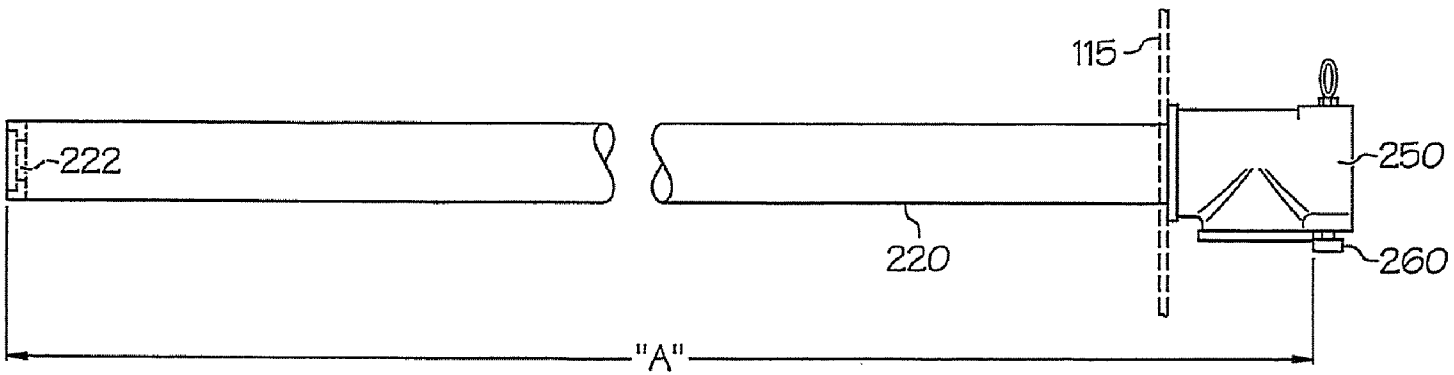
FIG. 4 is a side elevation view of another embodiment of a guide pipe and cooling air manifold to receive the flame scanner of FIG. 2.

Installation of the flame scanner 200 is accomplished by first inserting the optical head 201 of 200 down a guide pipe 220 as illustrated in either of FIGS. 3 and 4 which is installed through the windbox or boiler wall 115. On wall fired burners, an optional rigid guide pipe 220 may be used instead of a flexible guide pipe as shown in FIGS. 3 and 4. However, on titling tangential boilers a flexible guide pipe (not shown) is used to support the corner tilts. FIG. 3 illustrates the guide pipe 220 mounted to a cooling air manifold coupling assembly 250 which in turn may be coupled to a retrofit adapter 242 for coupling with the spool assembly 230. FIG. 4 illustrates the guide pipe 220 mounted to a cooling air manifold coupling 250 for coupling directly with the spool assembly 230, without the use of any adapter therebetween.

Figure 5:
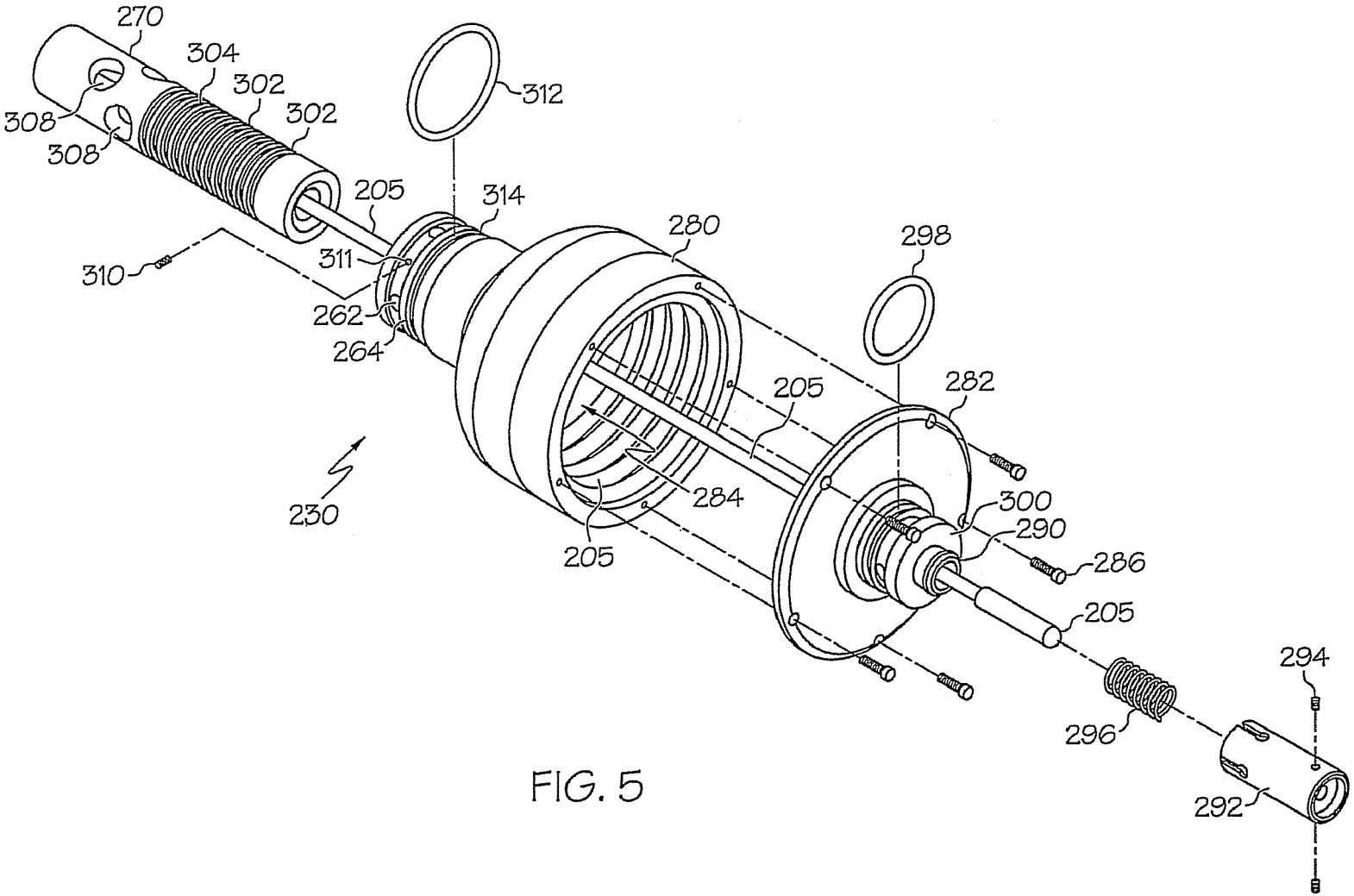
FIG. 5 is an enlarged exploded view of an exemplary embodiment of a spool housing, spool cover and mounting shaft of the spool assembly of FIG. 2 for matching a length of the either of the guide pipes of FIGS. 3 and 4.

Both the adapter 242 of FIG. 3 and cooling air manifold assembly 250 of FIG. 4 each include at least one pull pin 260 for securing the flame scanner 200 within the guide pipe 220 once installed therein. In addition, both guide pipes 220 of FIGS. 3 and 4 include a guide 222 configured to receive the scanner head 201 to properly seat the scanner head 201 into the correspondingly shaped guide 222 at the end of the guide pipe 220 at the boiler side. Referring to FIGS. 3-5, the pull pin 260 is received in a corresponding aperture 262 disposed in a barrel 264 defining one end of the spool assembly 230. In exemplary embodiments, two pull pins 260 are employed.

Referring to FIG. 5, an exploded perspective view of the spool assembly 230 is illustrated showing a portion of the fiber optic cable assembly 105 extending therethrough. The spool assembly 230 is connected to the rigid pipe 234 of FIG. 2 via a mounting shaft 270 therebetween. The spool assembly 230 includes a spool housing 280 and a spool cover 282 mountable to an opposite end of the spool housing 280 to cover a cavity 284 defined by the spool housing 280. The spool housing 280 includes the barrel 264 at one end and receives the spool cover 282 at an opposite open end. The spool cover 282 is retained with the spool housing 280 to close the opening at the open end with screws 286 (five shown). The spool housing 280 is telescopically mounted to the mounting shaft 270 via the barrel 264 discussed more fully hereinbelow. In an exemplary embodiment, the mounting shaft 270, spool housing 280 and cover 282 are formed of a rugged cast aluminum, for example, but is not limited thereto.

One end of the fiber optic cable 205 is disposed in the optical head 201 which houses a lens (not shown). An opposite end of the fiber optic cable 205 extends through an opening 290 in the cover 282 and is captured in a flame scanner light guide 292 using a pair of set screws 294. A compression spring 296 is disposed between the cover 282 and the light guide 292. Excess fiber optic cable 205 is simply coiled inside the cavity 284 of the aluminum housing 280, as illustrated in FIG. 5. An O-ring 298 may be used around a cylinder portion 300 extending from the cover 282 defining the opening 290 for coupling the detector head assembly 110 to the spool assembly 230.

As discussed above, the existing technology allows for only a fixed length flame scanner assembly, whereby the manufacturer must determine a dimension to a tolerance with the mating windbox, guide pipe or burner. In burner retrofit applications these dimensions and tolerances can change over time due to mechanical and thermal stresses. However, while only changing minimally in dimension, the performance of the optical flame scanner can greatly reduced. The scanner has an optical end, which scans for flame in the boiler and monitors the individual flame. These systems are often calibrated to operate within specific thresholds. If the scanner is not seated into its guide at the boiler side the calibration, flame characteristics will change.

Once installed in the guide pipe 220, the scanner head 201 has excellent visual access to the combustion flame within the boiler wall 115, if the scanner head 201 is properly seated into its guide 222 at the end of the guide pipe 220 at the boiler side. As discussed above, this is usually accomplished by matching the "L" dimension of the flame scanner 200 with the "A" dimension of the guide pipe 220. The "L" dimension of the scanner 200 is usually manufactured ⅜" to ½" longer than the "A" dimension of the guide pipe 220 to insure compression that will seat the tip of the flame scanner 200 firmly at the end of the guide pipe 220. In the prior art, changing the length of the flex hose 232 or the rigid pipe 234 of the scanner assembly sets the overall length or "L" dimension of the scanner assembly.

Referring again to FIG. 2, the overall length or "L" dimension of the scanner 200 according to an exemplary embodiment of the present invention is adjusted by varying a length of the spool assembly 230 for new and retrofit applications. The variable length of the spool assembly 230 ensures that the flame scanner 200 is always seated properly for maximum boiler flame sensitivity.

In particular, the means for adjusting the length of the spool assembly 230 is by means of the coupling between the barrel 264 defining one end of the spool housing 280 and a second barrel defined by the smaller diameter mounting shaft 270. The barrels defining the mounting shaft 270 and the one end of the spool housing 280 (e.g., barrel 264) are telescopically interconnected such that the longitudinal displacement between the end of the scanner head 201 and a terminal end of the barrel 264 defining the "L" dimension of the scanner assembly may be varied by slidable displacement of the barrels defining the mounting shaft 270 and the one end of the spool housing 280 (e.g., barrel 264) relative to one another.

A first end of the mounting shaft 270 includes a plurality of ribs 302 each spaced apart from one another defining a corresponding recess 304 between adjacent ribs 302. In an exemplary embodiment as illustrated in FIG. 5, the recesses 304 are cut into the mounting shaft 270 to circumferentially surround the shaft 270. The profile of the ribs and recesses 304 define substantially square cut grooves in an exemplary embodiment, but is not limited thereto. It also contemplated that the spaced apart ribs 302 and recesses 304 may define a single continuous recess (not shown) resembling a threaded mounting shaft 270 in an alternative exemplary embodiment.

The mounting shaft 270 is hollow to receive the fiber optic cable 205 therethrough in order for the fiber optic cable to extend to the lens assembly 101. A second opposite end relative to the first end having the recesses 304 of the mounting shaft 270 includes a plurality of apertures 308 extending to the hollow portion of the mounting shaft 270 to allow air from the cooling air manifold 250 to pass therethrough and make its way to the lens assembly 101.

As discussed above, the variability of length of the scanner 200 occurs between the mounting shaft 270 and spool housing 280. The first end of the mounting shaft 270 having the recesses 304 is inserted through the barrel 264 defining one end of the spool housing 280 and the selected length of the resulting spool assembly 230 is secured with two socket head set screws 310, in an exemplary embodiment, but is not limited thereto. The screws 310 extend through a corresponding aperture 311 disposed through the barrel 264 and fix the mounting shaft relative to the spool housing 280 by engagement within a corresponding recess 304 in the mounting shaft 270 and aligned therewith. The screws 310 can be loosened and the mounting shaft 270 can be extended from the barrel 264 of the spool housing 280, which in turn extends the length of the fiber optic cable 205 and overall length of the flame scanner 200 (FIG. 2). Likewise, the screws 310 can be loosened and the mounting shaft 270 can be retracted into the barrel 264 of the spool housing 280, which in turn reduces the length of the fiber optic cable 205 and overall length of the flame scanner 200 (FIG. 2).

In an exemplary embodiment, an O-ring 312 may be disposed in a corresponding groove 314 in the barrel 264 of the spool housing 280. The O-ring 312 forms a seal between the spool housing 280 and guide pipe assembly when the scanner assembly is installed in the guide pipe 220.

The above described design allows for variations in flame scanner length due to loose manufacturing tolerances or poor documentation yet still achieve a proper fit up in the field. A primary benefit of the above described exemplary design is realized when guide pipes stretch over the life of the boiler, this new improved variable length flame scanner assembly permits a quick field adjustment of the length of the "L" dimension that ensures that the optics are always seated in the hot end of the guide pipe.

More particular, there is no need to have tight tolerance matching "A" (guide pipe length) and "L" (flame scanner assembly) dimensions. Any scanner assembly will fit over a wide range. Further, variation in installation and compression will not be an issue. The scanner assembly will always seat in any guide pipe even with allowable variation of +/−inches in fit-up depending on the design. In addition, the scanner assembly can always be seated at the end of the guide pipe, even if the guide pipe stretches over time. This new improved design makes retrofits easier on existing guide pipes, as all guide pipes do not stretch the same.

In addition, the adaptation of the improved variable length flame scanner assembly described above eliminates the time consuming maintenance procedure required to readjust the scanner assembly length if it has pulled away from the guide pipe grip. The improved variable length flame scanner assembly ensures that the scanner is always seated and that the purge air from the cooling air manifold is directed through the scanner body across the lens or collimator.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for varying a length of a flame scanner assembly for monitoring a flame, comprising:

a mounting shaft which connects to a fiber optic cable assembly; and a spool assembly having a first end and a second opposite end, the first end connects to a detector head assembly and the second end is configured to connect to a guide pipe, wherein the second end of the spool assembly receives one end of the mounting shaft and a length of the flame scanner assembly is adjusted via telescopic interconnection between the second end of the spool assembly and the one end of the mounting shaft such that longitudinal displacement therebetween may be varied by slidable displacement of the mounting shaft relative to the spool assembly.

2. The apparatus of claim 1, wherein the length of the flame scanner assembly is adjusted to match a length of a guide pipe to which the flame scanner assembly is installed therein.

3. The apparatus of claim 1, wherein the slidable displacement of the mounting shaft relative to the spool assembly is prevented using a mechanical fastener therebetween to fix the longitudinal displacement therebetween.

4. The apparatus of claim 3, wherein the mechanical fastener includes at least one screw extending through the second end of the spool assembly to the mounting shaft.

5. The apparatus of claim 3, wherein the mounting shaft includes a plurality of recesses spaced apart from one another along a length defining a longitudinal portion of the mounting shaft, the recesses are configured to receive the mechanical fastener extending through the second end of the spool assembly to the mounting shaft, prevent slidable displacement of the mounting shaft relative to the spool assembly and fix the longitudinal displacement therebetween.

6. The apparatus of claim 5, wherein the plurality of recesses are spaced apart from one another along a fixed interval and define a corresponding rib between adjacent recesses.

7. The apparatus of claim 6, wherein each recess of the plurality of recesses circumferentially surrounds the mounting shaft.

8. The apparatus of claim 3, wherein the second end of the spool assembly includes at least one aperture to receive the mechanical fastener therethrough.

9. The apparatus of claim 8, wherein the spool assembly includes a spool housing connected to the second end and a cover encasing a cavity defined by the spool housing.

10. A flame scanner for monitoring a flame in a boiler, comprising:

a head assembly containing electronic components;

a lens assembly including a lens;

a fiber optic cable extending between the lens and the electronic components;

a spool assembly having a chamber disposed therein, the chamber receiving a portion of the fiber optic cable;

a sleeve disposed around the fiber optic cable and extending between the lens assembly and the spool assembly; and a mounting shaft disposed between the sleeve and the spool assembly;

wherein a length of the flame scanner is adjusted via telescopic interconnection between the spool assembly and the mounting shaft such that longitudinal displacement therebetween may be varied by slidable displacement of the mounting shaft relative to the spool assembly.

11. The flame scanner of claim 10, wherein the length of the flame scanner assembly is adjusted to match a length of a guide pipe to which the flame scanner assembly is installed therein.

12. The flame scanner of claim 10, wherein the slidable displacement of the mounting shaft relative to the spool assembly is prevented using a mechanical fastener therebetween to fix the longitudinal displacement therebetween.

13. The flame scanner of claim 12, wherein the mechanical fastener includes at least one screw extending through the second end of the spool assembly to the mounting shaft.

14. The flame scanner of claim 12, wherein the mounting shaft includes a plurality of recesses spaced apart from one another along a length defining a longitudinal portion of the mounting shaft, the recesses are configured to receive the mechanical fastener extending through the second end of the spool assembly to the mounting shaft, prevent slidable displacement of the mounting shaft relative to the spool assembly and fix the longitudinal displacement therebetween.

15. The flame scanner of claim 14, wherein the plurality of recesses are spaced apart from one another along a fixed interval and define a corresponding rib between adjacent recesses.

16. The flame scanner of claim 15, wherein each recess of the plurality of recesses circumferentially surrounds the mounting shaft.

17. The flame scanner of claim 12, wherein the second end of the spool assembly includes at least one aperture to receive the mechanical fastener therethrough.

18. The flame scanner of claim 17, wherein the spool assembly includes a spool housing connected to the second end and a cover encasing a cavity defined by the spool housing.

19. A method to vary a length of a flame scanner assembly to match a length of a guide pipe in which the flame scanner is installed for monitoring a flame, the method comprising:

disposing one end of a mounting shaft in a barrel defining one end of a spool assembly;

slidably displacing the mounting shaft relative to the spool assembly to adjust a length of the flame scanner in a telescopic manner; and extending a mechanical fastener through the one end of the spool assembly to the mounting shaft to prevent further slidable displacement of the mounting shaft relative to the spool assembly and fix a longitudinal displacement therebetween.

20. The method of claim 19, further comprising:

extending a pair of mechanical fasteners through corresponding apertures disposed at the one end of the spool assembly to be received in a corresponding recess in the mounting shaft, wherein the mounting shaft is configured with a plurality of recesses spaced apart from one another along a fixed interval and defining a corresponding rib between adjacent recesses.

* * * * *